US008511100B2

(12) United States Patent
Laskaris et al.

(10) Patent No.: US 8,511,100 B2
(45) Date of Patent: Aug. 20, 2013

(54) COOLING OF SUPERCONDUCTING DEVICES BY LIQUID STORAGE AND REFRIGERATION UNIT

(75) Inventors: Evangelos Trifon Laskaris, Schenectady, NY (US); John Arthur Urbahn, Saratoga Springs, NY (US); Albert Eugene Steinbach, Schenectady, NY (US)

(73) Assignee: General Electric Company, Niskyuna, NY (US)

( * ) Notice: Subject to any disclaimer, the term of this patent is extended or adjusted under 35 U.S.C. 154(b) by 1750 days.

(21) Appl. No.: 11/173,300

(22) Filed: Jun. 30, 2005

(65) Prior Publication Data

US 2007/0006598 A1 Jan. 11, 2007

(51) Int. Cl.
*F25B 19/00* (2006.01)
*F17C 7/02* (2006.01)

(52) U.S. Cl.
USPC ..... 62/51.1; 62/6; 62/50.1; 62/50.7; 62/259.2

(58) Field of Classification Search
USPC ..... 62/51.1, 6, 259.2, 50.7, 50.1
See application file for complete search history.

(56) References Cited

U.S. PATENT DOCUMENTS

| | | | | |
|---|---|---|---|---|
| 3,302,417 | A | 2/1967 | Cowans | |
| 3,850,004 | A * | 11/1974 | Vander Arend | 62/115 |
| 3,882,687 | A | 5/1975 | Asztalos | |
| 4,872,314 | A * | 10/1989 | Asano et al. | 62/49.1 |
| 5,193,349 | A * | 3/1993 | Laverman et al. | 62/64 |
| 5,513,498 | A | 5/1996 | Ackermann et al. | 62/51.1 |
| 5,848,532 | A | 12/1998 | Gamble | |
| 6,173,577 | B1 | 1/2001 | Gold | |
| 6,412,289 | B1 | 7/2002 | Laskaris et al. | 62/50.7 |
| 6,415,613 | B1 | 7/2002 | Ackermann et al. | 62/51.1 |
| 6,442,949 | B1 | 9/2002 | Laskaris et al. | 62/51.1 |
| 6,553,773 | B2 | 4/2003 | Laskaris | 62/64 |
| 6,725,683 | B1 | 4/2004 | Laskaris | |
| 6,732,536 | B1 | 5/2004 | Bonaquist | |

FOREIGN PATENT DOCUMENTS

EP 1355114 A 10/2003

* cited by examiner

*Primary Examiner* — John Pettitt
(74) *Attorney, Agent, or Firm* — Ann M. Agosti

(57) ABSTRACT

A system is disclosed for cooling superconducting devices. The system includes a cryogen cooling system configured to be coupled to the superconducting device and to supply cryogen to the device. The system also includes a cryogen storage system configured to supply cryogen to the device. The system further includes flow control valving configured to selectively isolate the cryogen cooling system from the device, thereby directing a flow of cryogen to the device from the cryogen storage system.

7 Claims, 3 Drawing Sheets

COOLING OF SUPERCONDUCTING DEVICES BY LIQUID STORAGE AND REFRIGERATION UNIT

STATEMENT REGARDING FEDERALLY SPONSORED RESEARCH & DEVELOPMENT

This invention was made with Government support under contract number DE-FC36-02-GO11100 awarded by Department of Energy. The Government has certain rights in the invention.

BACKGROUND

The invention relates generally to cooling systems, and in particular to a system and method for cooling a superconductive device.

Superconductivity is a phenomenon observed in several metals and ceramic materials. When these materials are cooled to temperatures ranging from near absolute zero (−459 degrees Fahrenheit, 0 degrees Kelvin, −273 degrees Celsius) to liquid nitrogen temperatures (−321 F, 77 K, −196 C), or even higher, they have no electrical resistance. Because these materials have no electrical resistance, they can carry large amounts of electrical current for long periods of time without losing energy as heat. This property has implications for electrical power transmission and for electrical devices, such as motors and generators. The temperature at which electrical resistance is zero is called the critical temperature or transition temperature and is different for different materials. Typically, critical temperatures are achieved by cooling superconductive materials with a cryogen, such as liquid helium or liquid nitrogen.

Devices such as motors and generators employ superconductors to improve their operating efficiency. Motors and generators typically include a stator mounted in a housing, and a rotor, which is disposed within the stator and can rotate during operation. In a generator, the rotor is coupled to a prime mover that rotates the rotor, producing a rotating magnetic field that induces a current in the stator. The current produced in the stator may be used to supply power to an electrical grid or other distribution network. In a motor, the stator produces a rotating magnetic field that interacts with the magnetic field produced by the rotor coils to induce rotation of the rotor. In practice, a motor may be reconfigured to function as a generator, or vice versa.

Conventionally, copper conductors are used to form the rotor coils. However, the electrical resistance of the copper conductors is sufficiently large to produce substantial resistive heat losses in the rotor coil of the generator or motor. These heat losses reduce the efficiency of the device. In response to the losses caused by conventional copper conductors, superconductors have been developed for use as rotor coils.

In devices employing a superconductive rotor coil, the rotor coil is typically cooled to reduce the temperature of the coil below its transition temperature. Typically, a cryogenic fluid or cryogen, such as liquid helium or liquid nitrogen, as discussed above, is provided to cool the rotor coils. The cryogenic fluid absorbs heat from the superconductive rotor coil, and maintains the rotor coil below the transition temperature and in a superconducting state. The cryogenic fluid is typically supplied by a refrigeration system that operates to maintain the fluid in a liquid state.

However, a power outage, a failure of the refrigeration system, or a maintenance shutdown of the refrigeration system may cause an interruption in the supply of the cryogenic fluid to the device. This interruption can result in ultimately raising the temperature of the coil beyond the transition temperature, and loss of superconductivity.

Accordingly, there is a need for a technique that enables uninterrupted supply of cryogenic fluid to superconducting devices, such as motors and generators.

BRIEF DESCRIPTION

The different embodiments described herein accordingly provide a novel approach to address the aforementioned problems with the addition of a cryogen storage system.

In one aspect, for example, a system for cooling a superconducting device is provided. The system includes a cryogen cooling system adapted to be coupled to the superconducting device. The cryogen cooling system is also configured to supply cryogen to the superconducting device. The system also includes a cryogen storage system configured to supply cryogen to the superconducting device. The system further includes flow control valving, wherein the flow control valving is selectively operable to isolate the cryogen cooling system from the superconducting device and direct a flow of cryogen to the superconducting device from the cryogen storage system.

In another aspect, a method is provided for continuously cooling a superconducting device. The method includes cooling the superconducting device using cryogen supplied via a cryogen cooling system. The method further includes isolating the superconducting device from the cryogen cooling system and coupling the superconducting device to a cryogen storage system.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present invention provides different embodiments that enable uninterrupted supply of cryogenic fluid or cryogen to superconducting devices, such as motors and generators. These embodiments are described in detail below.

Figure 1:
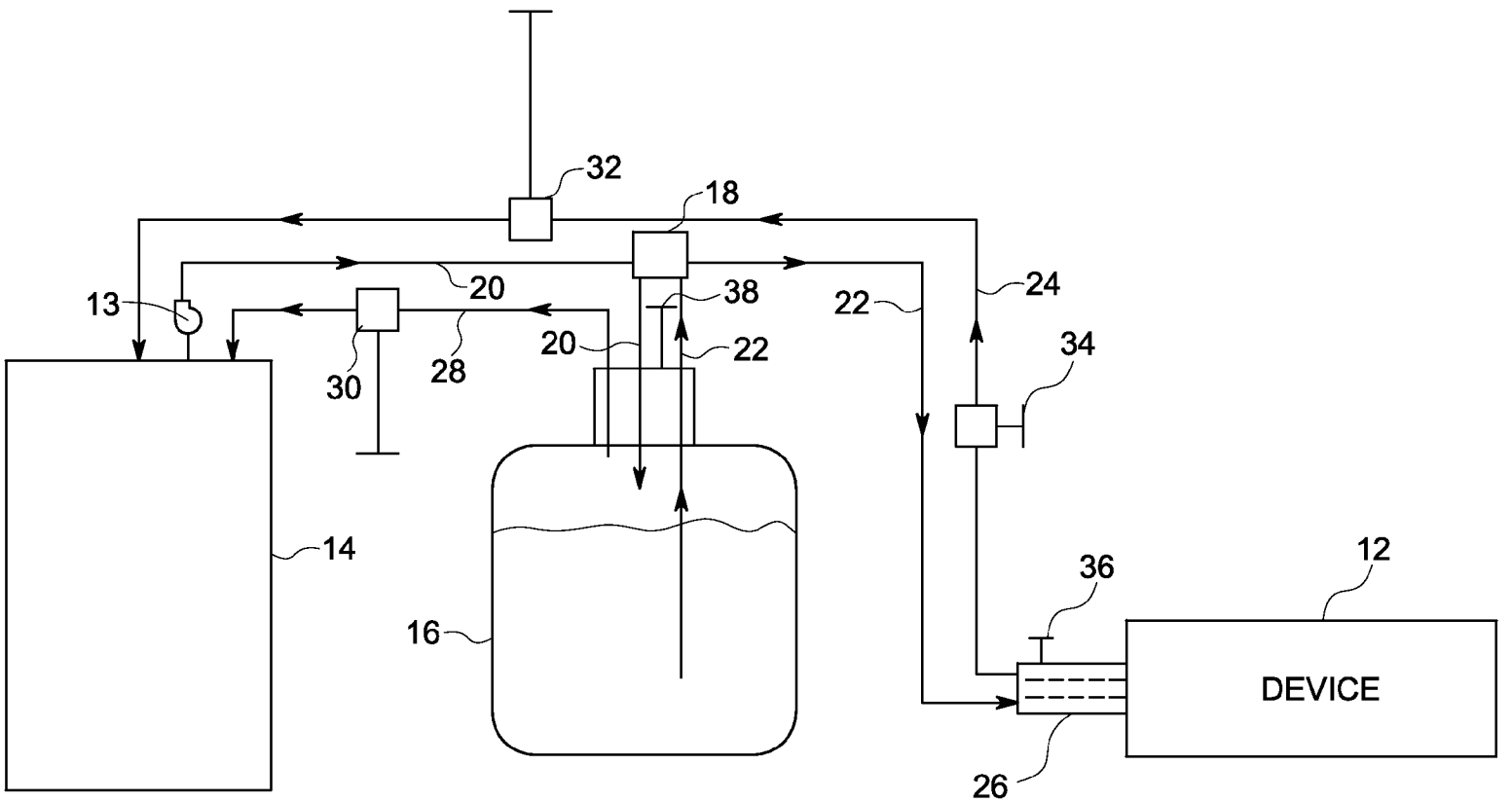
FIG. 1 is a diagrammatic view of an exemplary cooling system for cooling a superconducting device.

FIG. 1 illustrates a diagrammatic view of an exemplary cooling system 10 for cooling a superconducting device 12. The cooling system 10 includes a cryogen cooling system 14 and a cryogen storage system 16. The cryogen cooling system 14 and the cryogen storage system 16 are adapted to supply cryogen to the superconducting device 12. Cryogen as referred herein is a fluid that boils at below minus 160 degrees Celsius and is used typically as a refrigerant. Also, as described herein, the term "cryogen" includes both liquid and gaseous cryogens as both may be used in various implementations of the different embodiments described herein. In the present discussion, the cryogen is an inert fluid, such as neon or helium. However, as will be appreciated, the choice of the cryogen may not be limited to neon or helium. Temperatures that are suitable for superconducting devices are generally below minus 196 degrees Celsius and preferably around minus 246 degrees Celsius.

In the illustrated embodiment, the cryogen cooling system 14 is operable for producing liquid cryogen. Typically, as illustrated in the present embodiment, a liquefier may be used for producing liquid cryogens, or to liquefy cryogenic material from its gaseous phase. However, other methods known in the art may also be used for producing liquid cryogens.

The cooling system 10 further includes flow control valving 18 configured to isolate the cryogen cooling system 14 from the superconducting device 12. Furthermore, the cooling system 10 may also be advantageously adapted to direct a flow of cryogen to the superconducting device 12 from the cryogen storage system 16. The flow control valving 18 includes, in one example, a three-way valving system having multiple valves. For example, one such valve directs the flow of cryogen from the cryogen cooling system 14 to the device 12. Similarly, another valve directs the flow of cryogen from the cryogen storage system 16 to the device 12. Likewise, yet another valve directs the flow of cryogen from the cryogen cooling system 14 to the cryogen storage system 16. Such valves may be of any suitable type, and the particular arrangement or circuit may be varied from that shown.

The cryogen storage system 16 may be positioned at an elevated height relative to the device 12. When so elevated, gravity alone may cause the cryogen to flow to the device 12 from the cryogen storage system 16. However, where desired, an external pump 13 may be used to supply the cryogen to the device 12.

The cooling system 10 further includes multiple insulated (e.g., vacuum jacketed) transfer conduits for transporting the cryogen within the cooling system 10. The cooling system 10 also includes multiple valves for controlling the flow of cryogen within the cooling system 10. The details of the transfer conduits will be discussed in greater detail in the following sections.

The cryogen from the cryogen cooling system 14 flows through an inlet transfer conduit 20 to the cryogen storage system 16 for storing the cryogen. The cryogen from the cryogen storage system 16 flows to the device 12 through a vacuum jacketed transfer conduit 22. In an exemplary embodiment, the cryogen maintains the device 12 at cryogenic temperatures by evaporative cooling and ensures that the device 12 operates in superconducting conditions. The used cryogen, typically in the form of cold gas, exits the device 12 and flows through another vacuum jacketed return transfer conduit 24. The return transfer conduit carries the return cold gas from the device 12 to the cryogen cooling system 14. In a presently contemplated embodiment, the inlet transfer conduits (20 and 22) and return transfer conduit 24 are vacuum jacketed and thus heavily insulated. The vacuum insulation of the transfer conduits minimizes heat transfer losses in the cryogen as it flows from the cryogen cooling system 14 to the cryogen storage system 16, and from the cryogen storage system 16 to the device 12. The cryogen enters the device 12 via a transfer coupling 26. The transfer coupling 26 enables cryogen to be transferred to a shaft (shown in broken lines), or any other desired element of the device 12 at any point along the shaft.

Furthermore, in another exemplary implementation, the cryogen from the cryogen cooling system 14 may also be supplied to the superconducting device 12 directly as will be explained with reference to FIG. 2.

During maintenance or service interruptions of the cryogen cooling system 14, the flow control valving 18 isolates the cryogen cooling system from the device 12 and directs the flow of cryogen from the cryogen storage system 16 to the device 12. This helps in providing "ride through" or uninterrupted supply of cryogen to the device 12 during maintenance or breakdown of the cryogen cooling system 14.

The vapor generated in the cryogen storage system 16 due to evaporation (boil off) of liquid cryogen is transferred back to the cryogen cooling system 14 via another transfer conduit 28. During isolation of the cryogen cooling system 14 from the device 12, vapor generated in the cryogen storage system may be exhausted via a vent valve indicated by reference numeral 30, such as to limit or relieve pressure within the system. Likewise, vapor generated in the device 12 may be exhausted through another vent valve 32, when the cryogen cooling system is isolated from the device. The flow of the vapor generated in the device is controlled via a control valve 34.

During excess vapor generation and sudden increase in pressure in the device, a safety relief valve 36 may be disposed on the device 12 to vent the excess pressure. Likewise, another, safety relief valve 38 installed on the cryogen storage system 16 may be operable to release excess pressure generated in the cryogen storage system 16.

Figure 2:
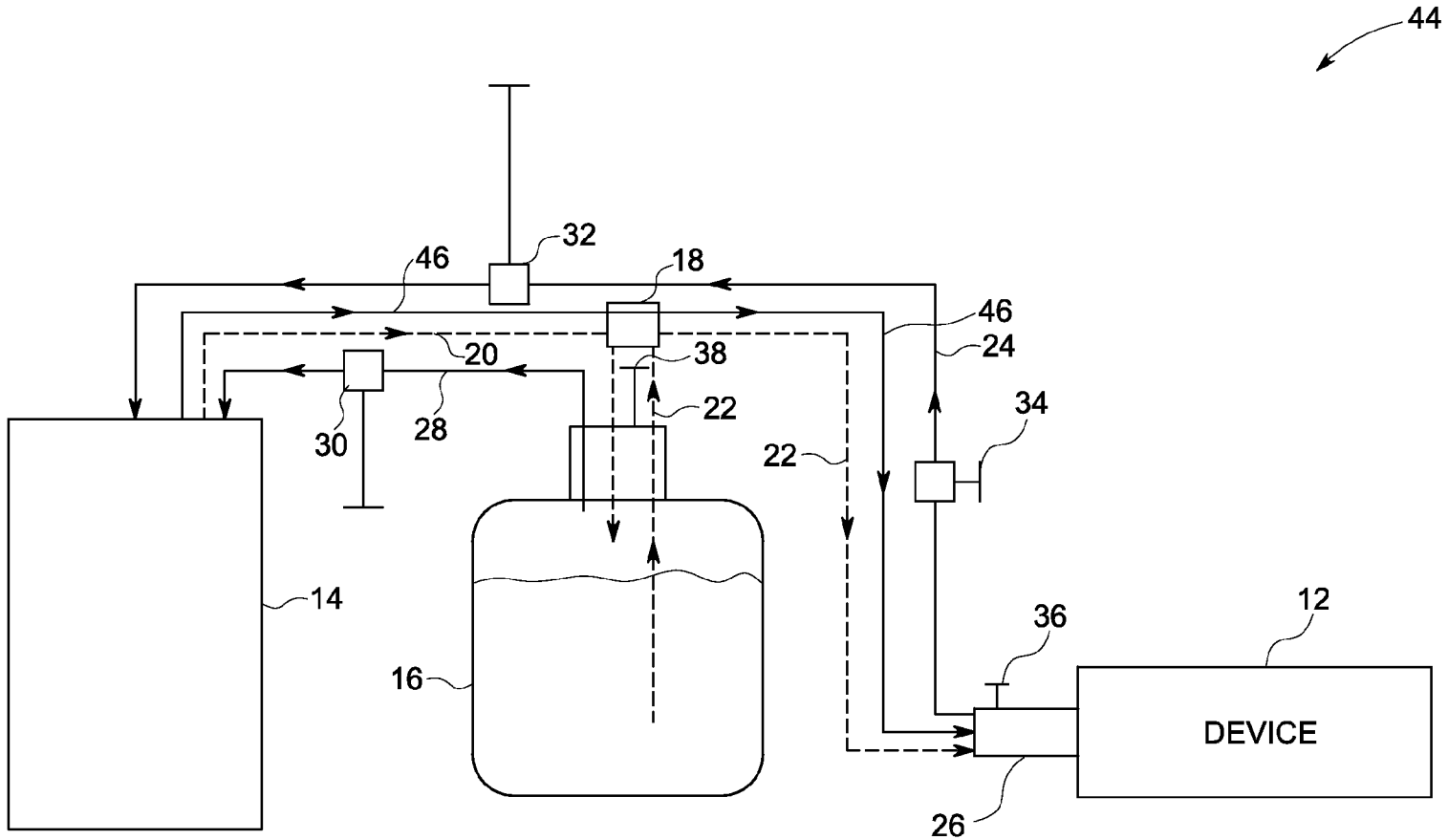
FIG. 2 is a diagrammatic view of another exemplary cooling system for cooling a superconducting device.

FIG. 2 illustrates a diagrammatic view of another exemplary cooling system 44 for cooling a superconducting device 12 where the cryogen cooling system 14 and cryogen storage system 16 are arranged in parallel to supply cryogen to the device 12. The functional components illustrated in the present embodiment have already been discussed in detail for the embodiment illustrated in FIG. 1. However, in the exemplary embodiment depicted in FIG. 2, the cryogen from the cryogen cooling system 14 directly flows to the device 12 via an inlet transfer conduit 46. As mentioned above, the cryogen supplied from the cryogen cooling system 14 may be stored in the cryogen storage system 16 via the inlet transfer conduit 20. During isolation of the cryogen cooling system 14 from the device 12, the cryogen stored in the cryogen storage system 16 supplies the cryogen to the device 12 via the inlet transfer conduit 22.

Figure 3:
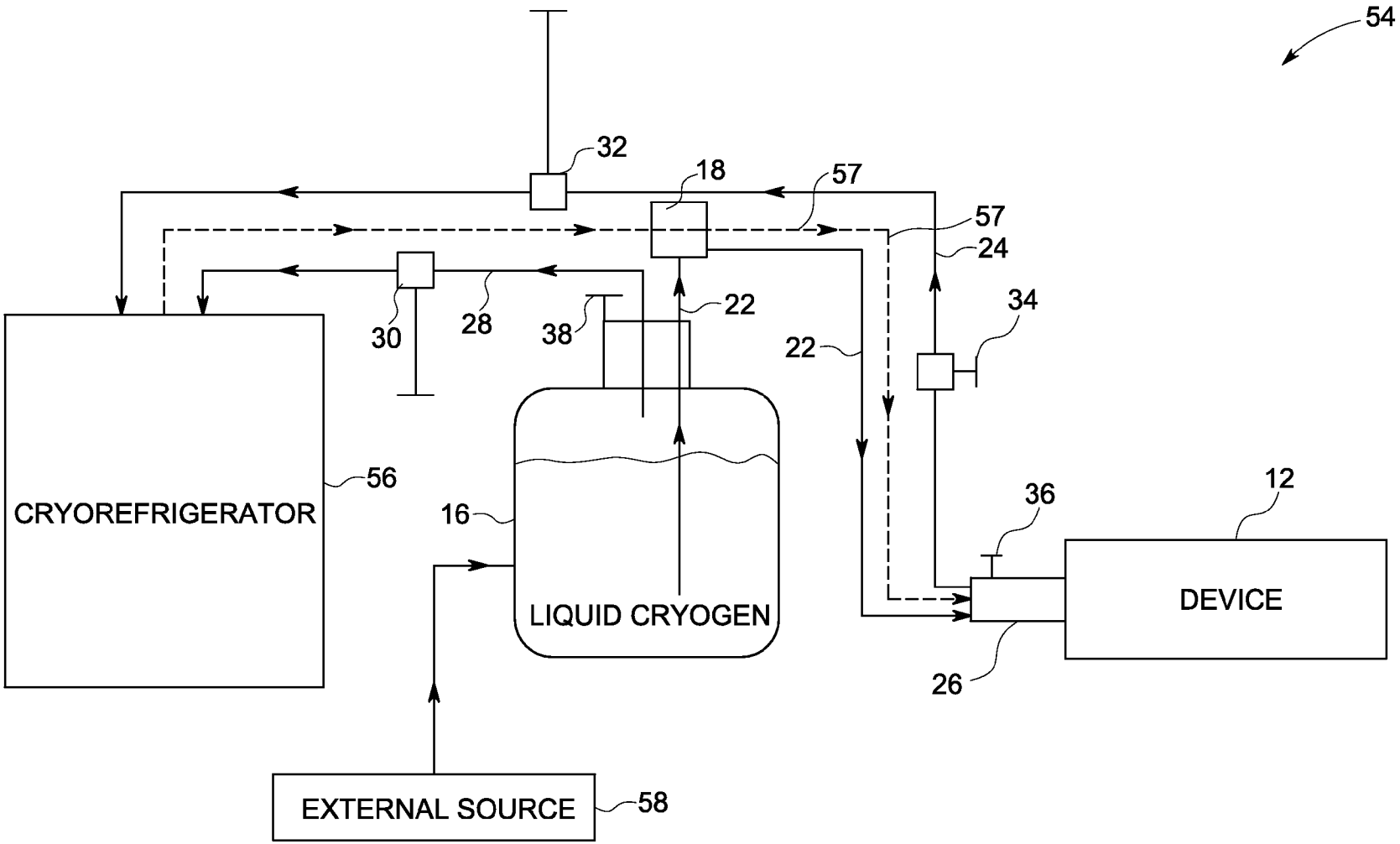
FIG. 3 is a diagrammatic view of yet another exemplary cooling system for cooling a superconducting device.

FIG. 3 illustrates a diagrammatic view of yet another exemplary cooling system 54 for cooling a superconducting device 12. The illustrated embodiment includes a cryorefrigerator 56 configured to supply cryogen directly to the device 12 via an inlet transfer conduit 57. The cryogen storage system 16 is also provided and is configured to store cryogen. The cooling system 54 further includes an external source 58 for providing liquid cryogen, which is used for refilling the cryogen storage system, in one example. It should be noted that the cryorefrigerator 56 produces gaseous cryogen that may be directly used for cooling the device 12. The external source 58 may include tanks, bottles, recipients and so forth, such as supplies received periodically from cryogen suppliers.

As discussed above, the cooling system 54 also includes flow control valving 18 configured to selectively isolate the cryorefrigerator 56 from the device 12 during maintenance and shut down of the cryorefrigerator 56. During the isolation of the cryorefrigerator 56 from the device 12, in order to supply uninterrupted cryogen to the device 12, the cryogen storage system 16 directs cryogen to the device 12. The cryogen may be supplied from the cryogen storage system to the device via the outlet transfer conduit 48.

The cryorefrigerator 56 may comprise one or more Gifford-McMahon or pulse-tube cold-head units, as required to meet the refrigeration capacity of the device. In one exemplary embodiment, the cryorefrigerator produces gaseous cryogen to supply to the device 12. In another exemplary embodiment, the cryorefrigerator 56 may be a recondenser that condenses vapor to liquid. During periods when the cryorefrigerator is shut down for maintenance, the cryogen storage system operates such that the cryogen vapor returned from the device is discharged to the outside atmosphere via the vent valve 32. The loss of cryogen in the cryogen storage system 16 is replenished by refilling the cryogen storage system 16 using the external source 58 (e.g. cryogen tankers) after the cryorefrigerator 56 is back in operation.

As explained in the sections above, in one implementation of the embodiments described herein, the cryogen from the cryogen cooling system may be gaseous cryogen and the cryogen from the cryogen storage system may be liquid cryogen. It should be noted that the embodiments discussed in FIGS. 1-3 explain that at any point of time, the flow of cryogen to the device is either from the cryogen cooling system or the cryogen storage system, and generally need not be from both.

It should be noted that the flow of cryogen from the cryogen cooling system 14 or the cryogen storage system 16, and operation of the various valves to control the flow of cryogen may be done automatically using a programmable logic controller, application-specific or general purpose computer, or other control circuitry. The controller stores a pre-set computer program based on the operating parameters of the cooling system. The program may be modified from time to time to suit any requirement of the cooling system.

As will be appreciated, the above described techniques ensure that the superconducting device is operable to receive constant supply of cryogen for cooling the device. During maintenance and shut down of the cryogen cooling system, in order to ensure uninterrupted supply of cryogen to the device, the cryogen storage system supplies the cryogen to the device. It should be noted that, although reference is made in the present description to cooling a superconducting device, and more particularly to a generator or motor, the present invention may find applications outside of such environments.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for cooling a superconducting device, comprising:

a cryogen cooling system configured to be coupled to the device and to supply cryogen to the device via a pump;

a cryogen storage system configured to supply cryogen to the device; and flow control valving configured to selectively permit flow of cryogen directly from the cryogen cooling system to the device and directly from the cryogen storage system to the device and to the cryogen cooling system, and to isolate the cryogen cooling system from the device and from the cryogen storage system, and to direct a flow of cryogen to the device from the cryogen storage system.

2. The system of claim 1, wherein the cryogen is a super cooled fluid comprising at least one of helium, nitrogen, hydrogen, or neon.

3. The system of claim 1, further comprising a cryogenic transfer coupling disposed radially around a rotatable shaft of the device, wherein the cryogenic transfer coupling is operable to direct the cryogen from the flow control valving to the device.

4. The system of claim 1, wherein the flow control valving is configured to selectively couple the cryogen cooling system or the cryogen storage system to a common inlet conduit for directing the cryogen to the device.

5. The system of claim 1, further comprising a return conduit for directing vapor generated by the device back to the cryogen cooling system.

6. The system of claim 5, further comprising a control valve disposed on the return conduit for regulating flow of the vapor generated by the device to the cryogen cooling system.

7. The system of claim 1, further comprising a vent valve for exhausting a vapor generated by the device when the device is isolated from the cryogen cooling system.

* * * * *